US006427597B1

(12) United States Patent
Aurenty et al.

(10) Patent No.: US 6,427,597 B1
(45) Date of Patent: Aug. 6, 2002

(54) METHOD OF CONTROLLING IMAGE RESOLUTION ON A SUBSTRATE

(76) Inventors: Patrice M. Aurenty, 27 Charter Oak St., Wood-Ridge, NJ (US) 07075; Edward Stone, 4 Inwood Rd., Morris Plains, NJ (US) 07950

( * ) Notice: Subject to any disclaimer, the term of this patent is extended or adjusted under 35 U.S.C. 154(b) by 0 days.

(21) Appl. No.: 09/492,643

(22) Filed: Jan. 27, 2000

(51) Int. Cl.[7] ..... B41C 1/10

(52) U.S. Cl. ..... 101/465; 101/457; 101/462; 347/96; 347/102

(58) Field of Search ..... 101/453, 454, 101/456, 457, 462, 463.1, 465–467; 347/88, 96, 99, 102, 105

(56) References Cited

U.S. PATENT DOCUMENTS

| | | | | |
|---|---|---|---|---|
| 3,877,372 A | | 4/1975 | Leeds | 101/465 |
| 4,003,312 A | * | 1/1977 | Gunther | 101/466 |
| 4,278,467 A | | 7/1981 | Fadner | 106/2 |
| 4,607,266 A | | 8/1986 | DeBonte | 346/140 PR |
| 4,638,337 A | | 1/1987 | Torpey et al. | 346/140 R |
| 4,652,893 A | | 3/1987 | Suzuki et al. | 346/140 R |
| 4,737,803 A | | 4/1988 | Fujimura et al. | 346/140 R |
| 4,740,801 A | | 4/1988 | Shimazaki | 346/140 R |
| 4,751,527 A | | 6/1988 | Oda | 346/140 R |
| 4,799,068 A | | 1/1989 | Saito et al. | 346/1.1 |
| 4,814,786 A | | 3/1989 | Hoisington et al. | 346/1.1 |
| 4,833,486 A | | 5/1989 | Zerillo | 346/1.1 |
| 4,854,969 A | | 8/1989 | Bassemir et al. | 106/2 |
| 4,870,432 A | | 9/1989 | Maeda et al. | 346/140 R |
| 4,873,539 A | | 10/1989 | DeYoung | 346/140 R |
| 4,916,468 A | | 4/1990 | Hayamizu | 346/140 R |
| 4,980,702 A | | 12/1990 | Kneezel et al. | 346/140 R |
| 5,019,675 A | | 5/1991 | Blessington et al. | 346/140 R |
| 5,045,870 A | | 9/1991 | Lamey et al. | 346/140 R |
| 5,084,713 A | | 1/1992 | Wong | 346/1.1 |
| 5,113,204 A | | 5/1992 | Miyazawa et al. | 346/140 R |
| 5,121,130 A | | 6/1992 | Hempel et al. | 346/1.1 |
| 5,122,812 A | | 6/1992 | Hess et al. | 346/1.1 |
| 5,170,187 A | | 12/1992 | Oikawa | 346/140 R |
| 5,182,578 A | | 1/1993 | Goepel et al. | 346/140 R |
| 5,202,702 A | | 4/1993 | Terasawa et al. | 346/1.1 |
| 5,208,611 A | | 5/1993 | Kappel et al. | 346/140 R |
| 5,312,654 A | | 5/1994 | Arimatsu et al. | 427/511 |
| 5,368,974 A | | 11/1994 | Walls et al. | 430/156 |
| 5,377,970 A | | 1/1995 | Kikuchi | 271/121 |
| 5,414,245 A | | 5/1995 | Hackleman | 219/548 |
| 5,424,767 A | | 6/1995 | Alavizadeh et al. | 347/17 |
| 5,508,722 A | | 4/1996 | Saito et al. | 347/17 |
| 5,511,477 A | | 4/1996 | Adler et al. | 101/401.1 |
| 5,519,423 A | | 5/1996 | Moritz, III et al. | 347/65 |

(List continued on next page.)

FOREIGN PATENT DOCUMENTS

| | | |
|---|---|---|
| CA | 2107980 | 4/1994 |
| EP | 0503621 | 9/1992 |
| EP | 591916 | 4/1994 |

(List continued on next page.)

OTHER PUBLICATIONS

"Cycloaliphatic Epoxide Systems", Union Carbide Chemicals & Plastics Technology Corp., Sales Brochure, 1989, 57 pages.

Monroe et al., "Photoinitiators for Free–Radical–Initiated Photo–Imaging Systems", *Chem. Rev.,* 1993, pp. 435–448.

"General Guide Formulating with Dow Epoxy Resin", The Dow Chemical Co., Sales Brochure, N/D.

*Primary Examiner*—Stephen R. Funk

(57) ABSTRACT

A method of preparing a printing plate for printing comprises applying a fluid composition by ink jetting to a substrate, and thereafter curing the fluid applied to the substrate. The fluid composition is jetted onto the substrate at a jetting temperature $T_2$. The substrate is at a temperature $T_s$. The viscosity of the fluid composition at temperature $T_s$ is about at least 300 times greater than the fluid's viscosity at temperature $T_2$. The invention minimizes the dot spreading which otherwise occurs when a substrate is imaged via ink jetting to prepare a printing plate.

43 Claims, 3 Drawing Sheets

U.S. PATENT DOCUMENTS

| | | | | | |
|---|---|---|---|---|---|
| 5,528,269 | A | | 6/1996 | Drogo et al. | 347/19 |
| 5,546,108 | A | | 8/1996 | Hotomi et al. | 347/55 |
| 5,657,061 | A | | 8/1997 | Seccombe et al. | 347/18 |
| 5,659,346 | A | | 8/1997 | Moynihan et al. | 347/68 |
| 5,695,908 | A | | 12/1997 | Furukawa | 430/205 |
| 5,719,605 | A | | 2/1998 | Anderson et al. | 347/59 |
| 5,721,311 | A | | 2/1998 | Oien | 524/590 |
| 5,738,013 | A | | 4/1998 | Kellett | 101/463.1 |
| 5,750,314 | A | | 5/1998 | Fromson et al. | 430/302 |
| 5,820,932 | A | | 10/1998 | Hallman et al. | 427/261 |
| 5,838,351 | A | | 11/1998 | Weber | 347/85 |
| 5,852,975 | A | * | 12/1998 | Miyabe et al. | 101/463.1 |
| 5,903,291 | A | | 5/1999 | Yoshimura et al. | 347/48 |
| 5,905,012 | A | | 5/1999 | De Meutter et al. | 430/124 |
| 6,019,045 | A | * | 2/2000 | Kato et al. | 101/466 |
| 6,058,841 | A | * | 5/2000 | Ray et al. | 101/465 |
| 6,131,514 | A | * | 10/2000 | Simons | 101/466 |
| 6,173,647 | B1 | * | 1/2001 | Kakuta et al. | 101/466 |
| 6,187,380 | B1 | * | 2/2001 | Hallman et al. | 101/463.1 |

FOREIGN PATENT DOCUMENTS

| | | |
|---|---|---|
| EP | 0776763 | 6/1997 |
| EP | 825031 | 2/1998 |
| EP | 0881584 | 12/1998 |
| EP | 0924064 | 6/1999 |
| GB | 2272866 | 6/1994 |
| GB | 2332646 | 6/1999 |
| JP | 60226575 | 11/1985 |
| JP | 4197777 | 7/1992 |
| JP | 0869108 | 3/1996 |
| JP | 0929926 | 2/1997 |
| JP | 1105288 | 1/1999 |
| JP | 1148630 | 2/1999 |

* cited by examiner

METHOD OF CONTROLLING IMAGE RESOLUTION ON A SUBSTRATE

FIELD OF THE INVENTION

This invention is directed to a method of controlling image resolution of a substrate such as a printing plate. The invention provides a method of preparing a printing plate in which a fluid composition is applied by inkjetting the fluid composition onto a substrate to form an oleophilic image area. This invention is also directed to such a printing plate for printing. This invention is further directed to a method of imaging a plate and a method of printing which advantageously minimizes the "dot spreading" of the fluid on a printing plate substrate, thereby avoiding the attendant low resolution and reduced image quality associated with such spreading.

BACKGROUND OF THE INVENTION

The offset lithographic printing process utilizes a planographic printing plate having oleophilic image areas and hydrophilic non-image areas. The plate is commonly dampened before or during inking with an oil-based ink composition. The dampening process utilizes an aqueous fountain solution such as those described in U.S. Pat. Nos. 3,877,372, 4,278,467 and 4,854,969. When water is applied to the plate, the water will form a film on the hydrophilic areas (i.e. the non-image areas of the plate) but will contract into tiny droplets on the oleophilic plate areas (i.e. the image areas). When a roller carrying an oil-based ink composition is passed over the dampened plate, it will be unable to ink the areas covered by the aqueous film (the non-image areas), but will emulsify the water droplets on the water repellant areas (the image areas) which will then take up ink. The resulting ink image is then typically transferred ("offset") onto a rubber blanket, which is then used to print onto a medium such as paper.

It has also been proposed to apply "direct" ink jet printing techniques to lithographic printing. For example, European Patent Publication No. 503,621 discloses a direct lithographic plate making method which includes jetting a photocuring ink onto the plate substrate, and exposing the imaged plate substrate to ultraviolet (UV) radiation to harden the image area. An oil-based ink may then be transferred to the image area for printing onto a printing medium. There is no disclosure of the resolution of ink drops jetted onto the substrate, or the durability of the lithographic printing plate with respect to printing runlength.

It has also been proposed to apply the direct ink jet printing techniques without the additional steps of chemical development. This "non-process" approach advantageously results in lower production costs and a more environmentally acceptable printing process. However, in such non-process techniques it is difficult to control the spreading of the fluid which forms the oleophilic ink-accepting portion on the printing plate substrate. Such "dot spreading" causes low printing image resolution and reduced image quality. For example, European Patent Application No. 591,916 A2 discloses a water-based ink having a polymer containing anhydride groups which are thermally cross-linked with a hydroxy-functional polymer. This formulation is applied by jetting the formulation which is at room temperature onto a room temperature substrate. However, this formulation does not achieve good control of dot spreading.

U.S. Pat. No. 4,833,486 discloses the apparatus and process for imaging a plate substrate with a "hot melt" type of ink jet printer. The image is produced by jetting at high temperature a "phase change" type of ink which solidifies when it contacts the cooler substrate. The ink becomes instantaneously solid rather than remaining a liquid or gel which is thereafter cured to form a solid. However, such an ink does not provide good resistance to press run due to the wax-type nature of the ink formulation.

U.S. Pat. No. 5,738,013 discloses a "media/fluid" system used in the manufacture of lithographic plates. The media is a conventional hydrophilic plate substrate, and the fluid is based on a transition metal complex reactive component. The control of dot spreading via the viscosity differences of the fluid as a function of temperature is not addressed.

European Patent Application No. 776,763 discloses lithographic printing plates having cationic curing epoxy systems which are jetted at high temperature onto a substrate. The viscosity of the heated epoxy curing system is 10 cps at jetting temperature, whereas the viscosity of the system at 25° C. is 75 cps.

U.S. Pat. No. 5,511,477 discloses a method for producing a photo polymeric relief printing plate using UV radiation curable ink that may optionally be preheated. Although letter-press, dry-offset, gravure and flexographic printing are disclosed, conventional offset printing is not addressed. The use of the viscosity-temperature relationship of the ink composition to control dot spreading is also not addressed.

Compositions intended for ink jet printers must be carefully formulated to satisfy demanding requirements, which include resistance to drying on the ink jet nozzles while stored in an ink jet print head, drying time, ink density and droplet spreading (expansion) once applied onto the printing substrate. These requirements can conflict. For example, the composition must not clog the small diameter nozzles of the ink jet printer over time. However, the ink must also be capable of rapid drying once it is applied to the printing substrate. In this regard, the drying time for a commercially available ink jet composition on a paper substrate is less than one second, with an advertised resolution of 1,440 dots-per-inch. See generally "Ink-jet Inks", *The Printing Ink Manual* (5th ed. 1993). It is also known to improve the resolution of ink jet printers by applying an ink receiving layer to printable substrates such as metal, plastic, rubber, fabrics, leather, glass and ceramics, prior to printing thereon.

In view of the foregoing, it is an object of this invention to provide a method of controlling spreading of a fluid composition on a substrate. In this regard it would be advantageous to provide a method of preparing a printing plate, particularly for non-process lithographic printing, which provides control of unwanted dot spreading and additionally provides good press run. It is one object of this invention to provide a method, wherein a fluid composition is applied by an ink jet printing apparatus to directly image a plate substrate, and thereby producing a printing plate for lithographic printing. The fluid composition applied to the plate substrate is cured and becomes an ink receptive layer for taking up ink when employed in a lithographic printing process.

It is yet another object of this invention to provide a method of controlling dot spreading for non-process lithographic printing plates.

Additional objects of this invention are to provide a method of imaging a lithographic plate and a method of lithographic printing using such a plate.

SUMMARY OF THE INVENTION

The present invention provides for controlling spreading of a fluid on a substrate. The printing plate of this invention is useful in printing processes, particularly so-called "non-process" printing which avoids chemical development steps.

The printing plate is prepared by ink jetting onto a plate substrate a fluid composition having a first viscosity at the temperature of the plate substrate, and having a second viscosity at a second temperature which is the temperature of the fluid composition as it leaves the ink jet head, wherein the ratio of the first viscosity to the second viscosity is about or greater than 300.

In a preferred embodiment, the printing plate is prepared by ink jetting onto a plate substrate a fluid composition having a first viscosity at or about room temperature and having a second viscosity at the temperature of the fluid leaving the ink jet head, typically greater than 25° C., wherein the ratio of the first viscosity to the second is about or greater than 300.

In a preferred embodiment the fluid composition comprises at least one noncycloaliphatic epoxy composition, at least one cycloaliphatic epoxy compound, and at least one ultraviolet radiation initiator compound.

This invention is also directed to a method of preparing a printing plate, by controlling the spreading of a fluid composition used to prepare the printing plate by ink jet, thereby avoiding unwanted dot spreading of the fluid composition and an accompanying reduction in image resolution, This invention is also directed to a method of lithographic printing employing such a plate.

DETAILED DESCRIPTION OF THE INVENTION

Figure 1:
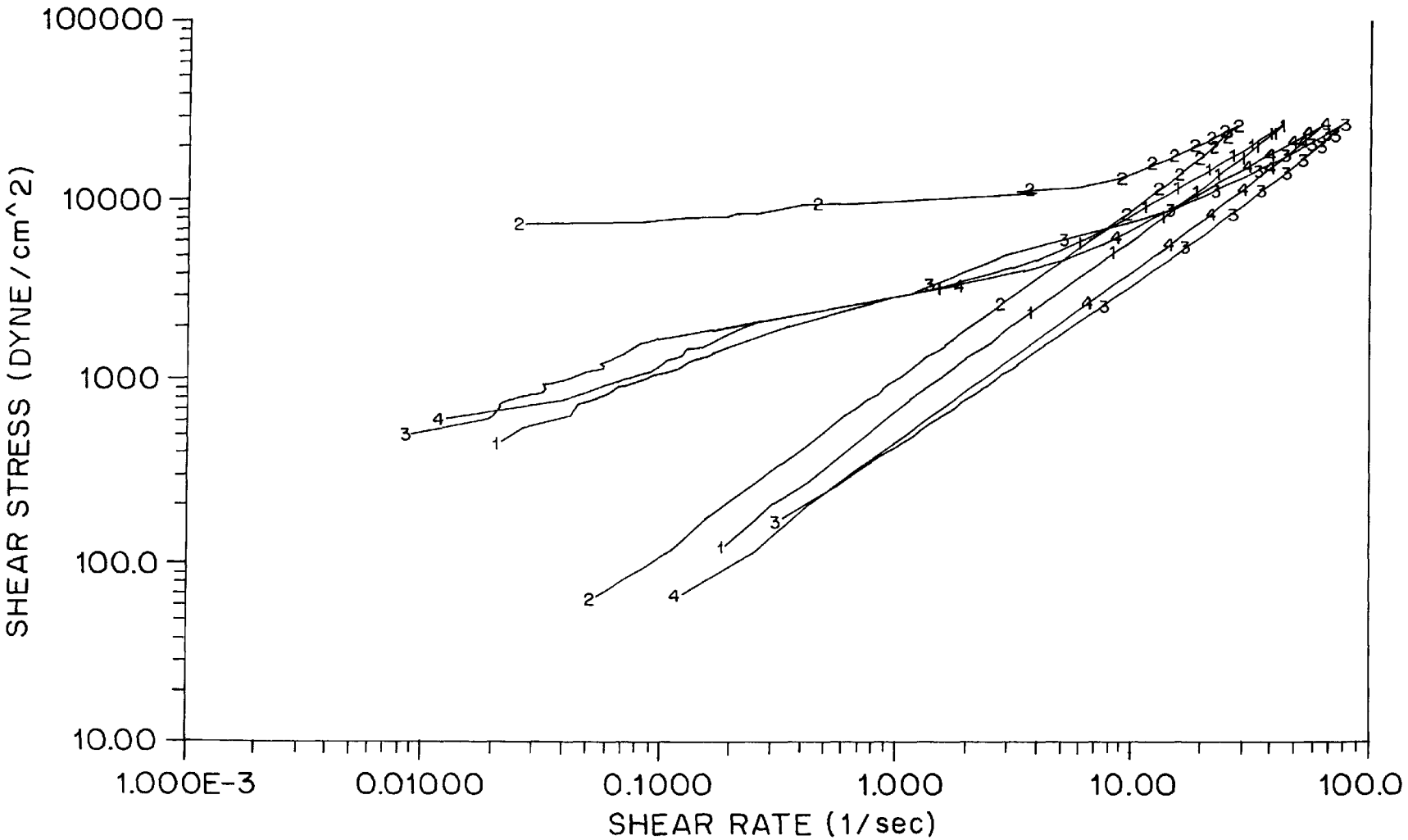
FIG. 1 is a graphical illustration of shear stress vs. shear rate for various fluid compositions in accordance with the invention.

The printing plate of this invention is prepared by applying an energy curable fluid composition to a plate substrate via ink jetting, and thereafter curing the fluid on the substrate to form an imaged printing plate having an ink receptive layer which receives ink when employed in the lithographic printing process. The term "fluid composition" as used herein refers to a composition which exhibits a measurable fluid viscosity, including but not limited to a liquid or a gel. By "energy curable fluid composition" it is meant a composition that, when applied by an ink jet print head onto a surface of a substrate, will form an image layer which, when cured, will adhere to the substrate and will accept subsequent application of printing ink conventionally used in lithographic printing. The fluid composition thus must satisfy the demanding performance requirements of ink jet ink compositions discussed above.

The fluid composition may, for instance, have a first viscosity at room temperature, i.e. approximately 25° C., and a second viscosity at a temperature greater than room temperature. Preferably the ratio of the first viscosity to the second viscosity is about or greater than 300. More preferably, the ratio of the first viscosity to the second viscosity is about or greater than 600, even more preferably about or greater than 2,500, most preferably about or greater than 50,000. In a preferred embodiment the fluid composition has a first viscosity in the range of 40 Pascal-seconds (Pa-s) to 30,000 Pa-s at about 25° C., i.e. the typical temperature of the substrate, and a second viscosity of 15 to 30 mPa-s at the temperature the fluid composition leaves the ink jet head, preferably about or greater than 120° C., more preferably about or greater than 150° C., most preferably about or greater than 180° C.

In particularly preferred embodiments, the temperature of the fluid composition leaving the head is such that the second viscosity of the fluid permits it to be applied by jetting.

The radiation curable fluid composition typically comprises one or more low molecular weight mono-functional or multi-functional monomers or oligomers. The energy curable fluid composition is characterized in that it is curable to a solid by exposure to energy from a radiant or thermal energy source. The fluid composition may be cured to a solid by exposure to high energy electrons from an electron beam source. Alternatively, curing may be initiated by energy activation of a polymerization initiating system, e.g. by UV radiation, as will be described in detail hereinbelow.

The fluid composition may include a ring opening polymerizable component, an addition polymerizable component, for example vinyl ethers, or a combination of ring opening and addition polymerization component. In either component, the fluid component is cured or hardened by polymerizing and/or crosslinking, at least the reactive monomers of the fluid composition. In order to reduce environmental contamination and maintain formulation integrity, the fluid composition is typically formulated with components having low volatility under ambient printing conditions.

In a preferred embodiment of the invention the polymerizable component is a cationic polymerizable system comprising one or more mono-functional or multi functional epoxides. Cationically polymerizable groups include epoxides, vinyl ethers, alkoxy styrenes and combinations thereof. The fluid composition typically includes at least one cycloaliphatic epoxide. Examples of such cycloaliphatic epoxides include adducts of epoxides and hydroxyl components such as glycols, polyols, or vinyl ether, such as 3,4-epoxycyclohexylmethyl 3,4-epoxy-cyclohexane carboxylate; bis (3,4-epoxy-cyclohexyl-methyl)adipate; limonene monoepoxide; limonene diepoxide; 1-vinyl-3,4-epoxycyclohexane; epoxidized dicyclopentyl alcohol; and mixtures thereof. Preferred cycloaliphatic epoxides of this type include 3,4-epoxycyclohexylmethyl 3,4-epoxy-cyclohexylcarboxylate which is commercially available under the trade name CYRACURE 6105 from Union Carbide Corporation and 1,3-bis(2-(7-oxabicyclo(4.1.0)hepta-3-yl)ethyl)-1,1,3,3-tetramethyldisiloxane.

At least one cycloaliphatic epoxy compound component, is present in the fluid composition in a concentration range of 50–90 weight %, preferably about 5–15 weight %, more preferably about 8–12 weight %. All weight percentages set forth herein for the fluid composition are based upon total weight of the fluid composition.

In addition to the cycloaliphatic epoxides the fluid composition may include one or more noncycloaliphatic epoxides, such as glycidyl ethers, glycidyl esters, or epoxidized alkenes. Suitable noncycloaliphatic epoxides also include diglycidyl ether of bisphenol A; an alpha-olefin epoxide, a novolac epoxide, epoxidized linseed oil, epoxidized soy oil; epoxidized polybutadiene; 1,2-epoxydecane; alkyl glycidylether; epoxidized silanes; glycidoxy-methoxy silane; and glycidoxy-ethoxy silane. A preferred noncycloaliphatic epoxide is a novolac epoxide which is commercially available under the trade name EPOXY NOVOLAC DEN 431, manufactured by Union Carbide. The epoxy composition is typically present in the fluid composition in a concentration range of 10–90 wt. %, preferably 70–90 wt. %.

A fluid composition including such noncycloaliphatic epoxides typically contains a cationic photoinitiating system activatable by actinic radiation such as UV or visible radiation.

Such a photoinitiator system has one or more compounds that directly furnish cations when activated by actinic radiation. The fluid composition typically comprises about 1–10 wt. %, preferably about 3–7 wt. % of at least one UV photoinitiator compound.

Such cationic initiating systems include all substances which liberate Lewis acids or Brönsted acids upon exposure to actinic radiation. Cationic photoinitiating systems which are particularly useful in the energy curable fluid compositions of this invention are onium salts. Especially suitable onium salts include triarylsulfonium phosphate, triarylsulfonium antimonate, diaryliodonium hexafluoroantimonate, bisdodecyldiphenyliodonium hexafluoroantimonate, and the like. Such cationic photoinitiators may be used individually or in combination to effect suitable curing of the ink. Also useful are metallocene salts, such as ($\eta^5$-2,4-cyclopentadien-1-yl)[(1,2,3,4,5,6-n)(1-methylethyl)benzene]-iron$^+$-hexafluorophosphate(−1). Preferred are photoreactive sulfonium salts available from Union Carbide under the trade names CYRACURE UVI 6974 a triaryl sulfonium hexafluoroantimonate salt and CYRACURE UVI 6990, a triarylsulfonium hexafluorophosphate salt.

Alternatively, when the energy curable fluid composition may be cured by a free radical addition polymerizable composition, the fluid composition comprises a liquid composition including compounds having terminal ethylenic unsaturation.

Generally, the liquid composition includes an ethylenically unsaturated mono- or multi-functional monomer. The monomer is a lower molecular weight ethylenically unsaturated compound which forms a polymer directly upon initiation by free radicals generated by absorbed energy. In some formulations an oligomeric or polymeric component which can be further polymerized may also be present. In such cases the further polymerizable material will be soluble in, or dispersible in the monomer vehicle.

Typically, the monomeric compounds have one, two, or more terminal ethylenically unsaturated groups. Representative of such monomeric compounds are: N-vinyl pyrrolidinone; dipropylene glycol diacrylate; tripropylene glycol diacrylate; butanediol diacrylate; hexanediol diacrylate; trimethylol propane triacrylate; ethoxylated trimethylol propane triacrylate; glycerol-propoxy triacrylate; pentaerythritol triacrylate; dipropylene glycol dimethacrylate; tripropylene glycol dimethacrylate; butanediol dimethacrylate; hexanediol dimethacrylate; trimethylol propane trimethacrylate; di-(3-methacryloxy-2-hydroxypropyl ether) of bisphenol-A; di(2methacryloxyethyl ether) of bisphenol-A; di-(3-acryloxy-2-hydroxypropyl ether) of bisphenol-A; di(2-acryloxyethyl ether) of bisphenol-A; and the like. The monomeric compounds are present in an amount of 5 to 90 wt. %, preferably 10–50 wt. %, more preferably 10–20 wt. % of the fluid composition.

To achieve the desired viscosity and crosslinking properties, typically the fluid composition contains a combination of multifunctional acrylic monomers along with a monomer containing a single terminal ethylenic group.

When the fluid compositions of this invention include an oligomeric or polymeric material, said materials typically possess ethylenic unsaturation which can react with the ethylenically unsaturated monomers. Representative of such oligomers are acrylated epoxy resins; acrylated polyurethanes; acrylated polyesters; and the like.

The fluid compositions of the present invention may also contain a preformed polymer such as an acrylic polymer or copolymer of $C_1$–$C_4$ alkyl acrylates or methacrylates, or acrylic or methacrylic acid, vinyl polymers and copolymers such as polyvinyl chloride, polyvinyl acetate, polyvinyl alcohol, polyvinylpyrrolidone, cellulosic polymers and copolymers; and the like.

Free radical polymerization initiating systems typically require irradiation of a photoinitiator to produce free radicals that initiate polymerization. A wide variety of these photoinitiators may be used in the energy curable inks of this invention. Examples of suitable photoinitiators are described by B. M. Monroe and G. C. Weed in *Photoinitiators for Free-Radical-Initiated Photo-Imaging Systems*, Chem. Rev. 93, pp. 435–48 (1993), incorporated herein by reference. The reference describes the use of thioxanthone, ethyl 4-(dimethyl-amino) benzoate, alpha amino acetophenone, and Michler's ketone as photoinitiators. The photoinitiator is present in an amount of 1 to 10 wt. %, preferably 3–7 wt. %, more preferably 5 wt. % of the fluid composition.

Combinations of cationic and free radical polymerizable compositions may be used along with their respective photoinitiating systems.

The fluid composition may also contain about 1–25 wt. %, preferably about 8–12 wt. %, of di-trimethylol propane (DTMP), commercially available, for example, from PERSTORP, Toledo, Ohio.

The fluid composition may also contain colorants, corrosion inhibitors and anti-foaming agents.

The fluid composition may be applied to a suitable plate substrate to produce a high resolution, printable medium having a desired image. It is especially preferred to prepare the printable medium or media by using a conventional drop-on-demand ink jet printer to apply the fluid composition. Suitable ink jet printers include piezoelectric and bubble jet printers.

The lithographic printing plate of this invention is prepared by applying the fluid composition of this invention to a printing plate substrate. Any conventional printing plate substrate, such as aluminum, polymeric film and paper, may be used as the printing plate substrate of this invention. Roughened aluminum is preferred.

The printing plate substrate may be subjected to known treatments, such as electrograining, anodization, and silication, to enhance its surface characteristics. The printing plate surface may carry a plurality of basic sites, such as sodium silicate groups. Alternatively, the printing plate substrate surface may carry a plurality of acidic sites, such as sulfuric acid groups, phosphonic acid groups and acrylic acid groups, or the surface may be amphoteric.

Particularly suitable plate substrates for use in this invention are given in Table 1. Preferably, such substrates are based on aluminum oxide and may be subjected to various conventional surface treatments as are well known to those skilled in the art. These treatments result in different roughnesses, topologies and surface chemistries, as summarized in Table 1.

TABLE 1

| Substrate Refs. | Surface Treatment | Interlayer Treatment | Surface Property |
|---|---|---|---|
| AA | Quartz Grained and Anodized | None | Acidic |
| EG-PVPA | Electrograined and Anodized | Polyvinyl phosphonic acid | Acidic |
| EG-Sil | Electrograined and Anodized | Sodium Silicate | Basic |
| G20 | Electrograined and Anodized | Vinylphosphonic acid/acrylamide coplymer | Acidic |
| DS-Sil | Chemically Grained and Anodized | Sodium Silicate | Basic |
| PG-Sil | Pumice Grained and Anodized | Sodium Silicate | Basic |
| CHB-Sil | Chemically Grained, Anodized and Silicated | Sodium Silicate | Basic |

"AA" means "as anodized." The aluminum surface is first quartz grained and then anodized using DC current of about 8 A/cm$^2$ for 30 seconds in a $H_2SO_4$ solution (280 g/liter) at 30° C.

"EG" means "electrolytic graining." The aluminum surface is first degreased, etched and subjected to a desmut step (removal of reaction products of aluminum and the etchant). The plate substrate is then electrolytically grained using an AC current of 30–60 A/cm$^2$ in a hydrochloric acid solution (10 g/liter) for 30 seconds at 25° C., followed by a post-etching alkaline wash and a desmut step. The grained plate substrate is then anodized using DC current of about 8 A/cm$^2$ for 30 seconds in a $H_2SO_4$ solution (280 g/liter) at 30° C.

"PVPA" is a polyvinylphosphonic acid. The plate substrate is immersed in a PVPA solution and then washed with deionized water and dried at room temperature.

"DS" means "double sided smooth." The aluminum oxide plate substrate is first degreased, etched or chemically rained, and subjected to a desmut step. The smooth plate is then anodized.

"Sil" mean s the anodized plate is immersed in a sodium silicate solution. The coated plate substrate is then rinsed with deionized water and dried at room temperature.

"PG" means "pumice grained." The aluminum surface is first degreased, etched and subjected to a desmut step. The plate substrate is then mechanically grained by subjecting it to a 30% pumice slurry at 30° C., followed by a post-etching step and a desmut step. The rained plate substrate is then anodized using DC current of about 8 A/cm$^2$ for 30 seconds in an $H_2SO_4$ solution (280 g/liter) at 30° C. The anodized plate substrate is then coated with an interlayer.

"G20" is a printing plate substrate which is described in U.S. Pat. No. 5,368,974, the disclosure of which is incorporated herein by reference in its entirety.

"CHB" means chemical graining in a basic solution. After an aluminum substrate is subjected to a matte finishing process, a solution of 50 to 100 g/liter NaOH is used during graining at 50 to 70° C. for 1 minute. The grained plate is then anodized using DC current of about 8 A/cm$^2$ for 30 seconds in an $H_2SO_4$ solution (280 g/liter) at 30° C. The anodized plate substrate is then coated with a silicated interlayer.

Those of ordinary skill in the art will understand that the "basic" and acidic" descriptions of the surface chemistry of the printing plate substrates summarized above are relative terms. Thus, a "basic" surface will have a plurality of basic sites and acidic sites present, with the basic sites predominating to some degree. Similarly, an "acidic" surface will have a plurality of acidic sites and basic sites present, with the acidic sites predominating to some degree. The PG-silicated printing plate substrate appears to have a higher silicate site density than the double-sided printing plate substrate, and is more basic. The G20 printing plate substrate exhibits less acidic behavior than anodized only ("AA") printing plate substrates.

When the printable medium such as a printing plate is prepared by ink jet application of the fluid composition onto a printing plate substrate and subsequent curing, the resulting oleophilic ink receptive image layer comprises a plurality of dots forming a desired image to be printed. The spreading of these dots has an adverse effect on the resolution of the image applied to the plate substrate, and ultimately, the printed image.

Without intending to be bound by any one theory, it is believed that the magnitude of the increase in viscosity of the fluid composition between the jetting temperature, for example about or greater than 120° C., and the temperature of the substrate, for example about 25° C., prevents the spreading of droplets of the fluid. It is also believed that, in embodiments of this invention including the use of DTMP, a compound which has a plurality of OH units, the DTMP enables establishment of a gel structure on the surface of the substrate as the ink composition cools subsequent to the jetting application to the substrate and facilitates hydrogen bonding gelling behavior due to the hydroxyl groups, and thus mitigates against dot spreading. Such hydrogen bonding is believed to occur immediately upon impact of the fluid composition upon the cooler substrate surface, even though this involves a very short time scale.

The printing plate is prepared by imagewise jetting the fluid composition upon the plate substrate, and thereafter curing the fluid composition on the substrate. The substrate is fixed on a plate holder. Suitable plate holders include a substrate on a rotative drum or an X-Y table. Upon application of the fluid composition to a rotative drip as described in U.S. Pat. No. 5,511,477 incorporated by reference herein, the printing head moves only on the cross direction while the drum is rotating. On the opposite side of the printing head, a UV lamp is fixed in order to cure the fluid dots right after being deposited on the plate. Utilizing an X-Y table, the plate substrate is fixed on the table and the print head moves in the X or Y direction. The plate substrate is either imaged completely and then cured or imaged and cured at the same time by using a UV fiber optic attached on the side of the moving head.

The following examples illustrate preferred embodiments of the invention, and are not intended to limit the scope of the invention in any way.

Each of the compositions in the examples hereinafter are below prepared by slowly mixing together each of the composition components, except for the initiator, at 120° C. using a laboratory mixer at slow speed for 10 minutes. After obtaining a homogeneous mixture the initiator was slowly added with stirring.

The rheological properties of the compositions were measured using a cone/plate rheometer model CSL500 from TA instrument. The cone used was 4 cm in diameter and 2 degrees in angle.

Figure 2:
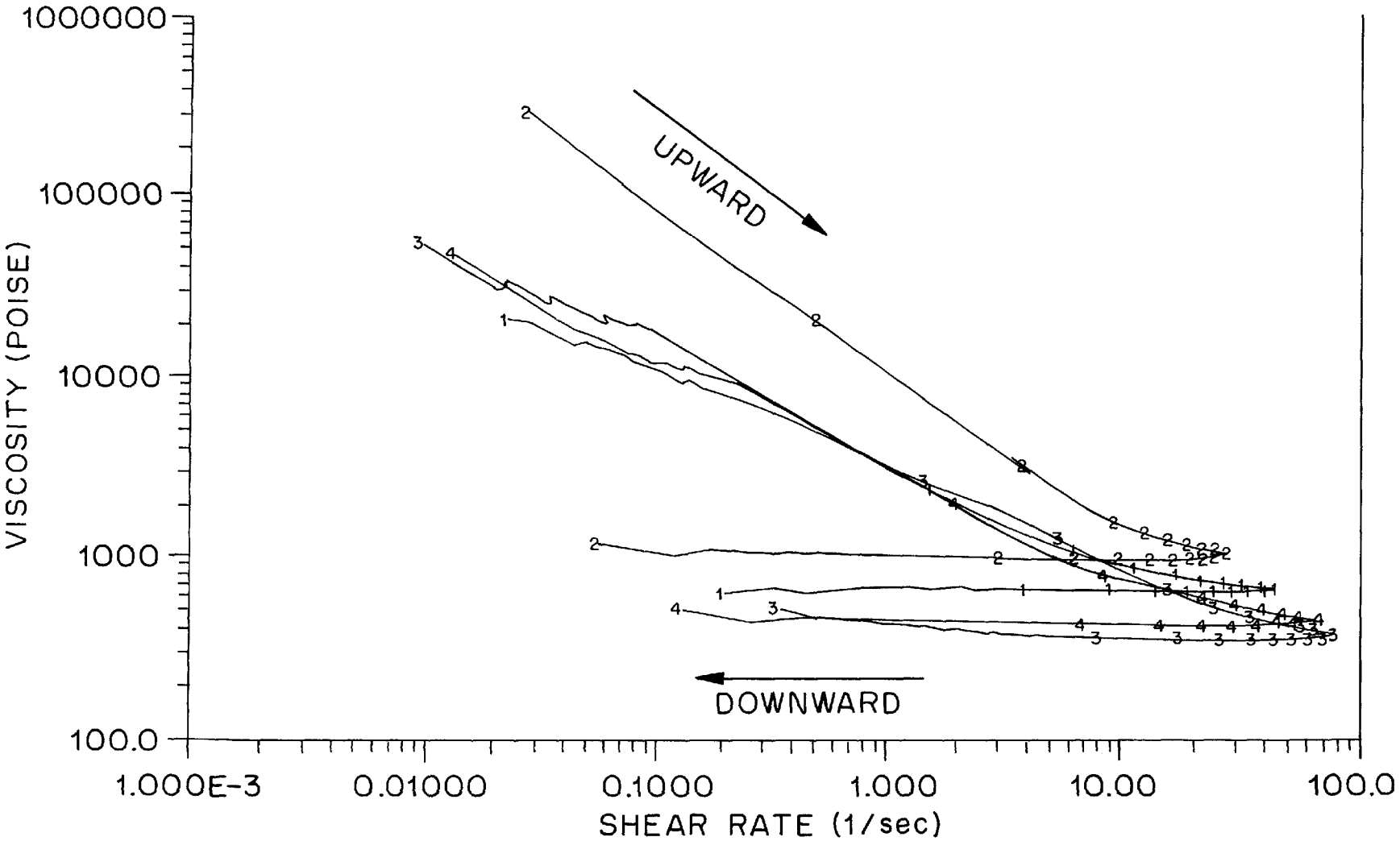
FIG. 2 is a graphical illustration of viscosity vs. shear rate for various fluid compositions in accordance with the invention.

As illustrated in FIGS. 1 and 2 a "thixotropic loop" at room temperature, i.e., variation of shear stress and viscosity vs. shear rate, was obtained by increasing and decreasing shear stress over a 30 minutes period of time. Curve 1 is the viscosity profile for Example 5, Curve 2 is the viscosity profile for Example 6, Curve 3 is the viscosity for Example 3 and Curve 4 is the viscosity for Example 4, respectively. The procedure used for determining the viscosity and shear stress variation with shear rate was as follows. The sample was loaded at 120° C. Temperature was decreased to 25° C. at a rate of 10 degrees/minute and stabilized at 25° C. for 10 minutes. A linear stress ramp from 0 to 28,000 Pa (upward) was applied to the sample over a 15 minute interval. Immediately thereafter, a decreasing ramp of stress from 28,000 Pa to 0 Pa (downward) was applied to the sample over 15 minutes. A large "thixotropic" effect is observed. On the upward curve, the viscosity decreases with shear rate. On the upward curve at very low shear rates near the "yield" stress, i.e. shear rates below about 0.1 $s^{-1}$, the viscosity is in the range of 2,000 to 30,000 Pa·s (20,000 to 300,000 poise). The yield stress is the minimum applied stress at which the cone begins to rotate under the conditions used to generate the upward curve. Distinctly, on the downward curve, low constant viscosities of about 50 Pa·s for Examples 3 and 4, about 70 Pa·s for Example 5, and about 150 Pa·s for Example 6 were observed with shear rate, indicating that the physical network structure was destroyed by the upward shear stress ramp.

The viscosity of the compositions at 100 $s^{-1}$ was recorded at room temperature and 120° C. with the same rheometer and the same cone/plate measuring geometry. Values of 15 to 25 mPa·s at 120° C. were obtained which is suitable for jettability with several DOD ink jet printer heads.

EXAMPLE 1

A fluid composition was prepared including 85 wt. % EPOXY RESIN DER 331 an epoxy resin commercially available from Dow Chemical, 10 wt. % CYRACURE 6105 and 5 wt. % CYRACURE UVI 6990. The composition had a viscosity of 18 mPa-s at 120° C. and 6 Pa-s at 25° C.

EXAMPLE 2

A fluid composition was prepared included 84.2 wt. % EPOXY NOVOLAC DEN 431, 10.1 wt. % CYRACURE 6105, and 5.3 wt. % CYRACURE UVI 6990. The composition had a viscosity of 15 mPa-s at 120° C. and a viscosity of 40 Pa-s at25° C.

EXAMPLE 3

A fluid composition was prepared comprising 75 wt. % EPOXY NOVOLAC DEN 431, 10 wt. % CYRACURE 6105, 10 wt. % DTMP, and 5 wt. % CYRACURE UVI 6974. The composition had a viscosity of 25 mPa-s at 120° C. and a viscosity of 5,000 Pa-s at 25° C. and at yield stress of approximately 500 $N/m^2$.

EXAMPLE 4

A fluid composition was prepared comprising 80 wt. % EPOXY NOVOLAC DEN 431, 10 wt. % CYRACURE 6105, and 10 wt. % DTMP. The composition had a viscosity of 25 mPa-s at 120° C. and a viscosity of 5,000 Pa-s at 25° C. and at yield stress=500 $nm^2$. This example could not be cured due to the absence of a UV initiator compound.

EXAMPLE 5

A fluid composition was prepared comprising 85 wt. % EPOXY NOVOLAC DEN 431, 10 wt. % DTMP, and 5 wt. % CYRACURE UVI 6974. The composition had a viscosity of 25 mPa-s at 120° C. and a viscosity of 1,500 Pa-s at 25° C.

EXAMPLE 6

A fluid composition was prepared to comprising 75 wt. % EPOXY NOVOLAC DEN 431, 20 wt. % DTMP, and 5 wt. % CYRACURE lVI 6974. The composition had a viscosity of 25 mPa-s at 120° C. and a viscosity of 30,000 Pa-s at 25° C.

The fluid compositions of Examples 1–4 were applied via ink jet printer to printing plate substrates at room temperature. Examples 5 and 6 were not applied via jetting due to high temperature stability problems. The jetting temperature was approximately 120° C. The substrates used were either EG-silicate or EG-PVPA. The Image layer was cured at 75 fpm, with 2 lamps having an output of 300 Watts/inch in the UV spectral region and a cylindrical reflector. The image layer exhibited good adhesion on both types of substrates, good resistance to water and good scratch resistance and a value of 50 for methyl ethyl ketone (MEK) rub resistance after one day. MEK rub resistance was determined by rubbing a cotton tipped applicator dipped in MEK back and forth across the image layer. The back and forth movement across the image layer is counted as one rub event.

Figure 3A:
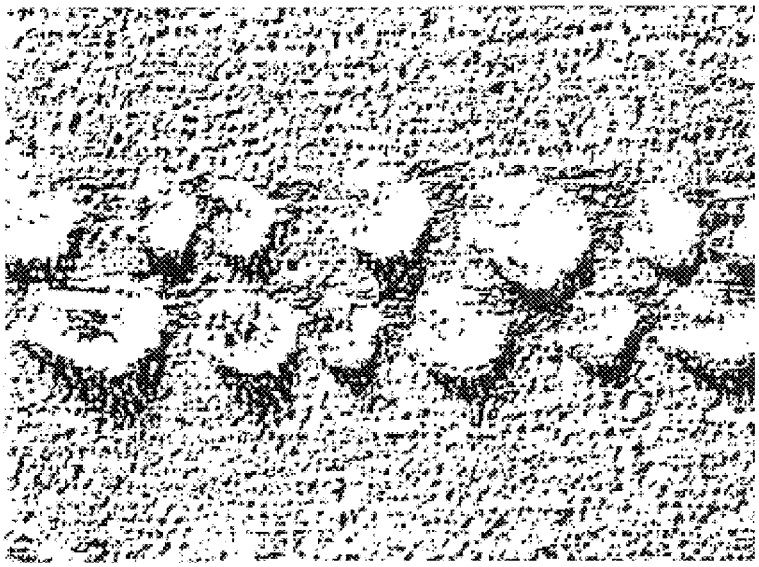
FIGS. 3A–3C are photographs depicting dot spreading of a fluid composition on a printing plate substrate according to this invention (FIGS. 3A and 3B) compared to dot spreading of a conventional hot melt phase change ink on the same substrate (FIG. 3C).
Figure 3B:
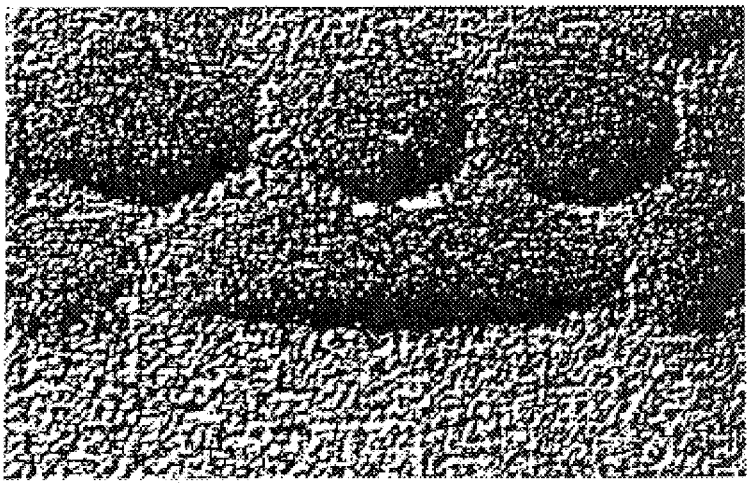
Figure 3C:
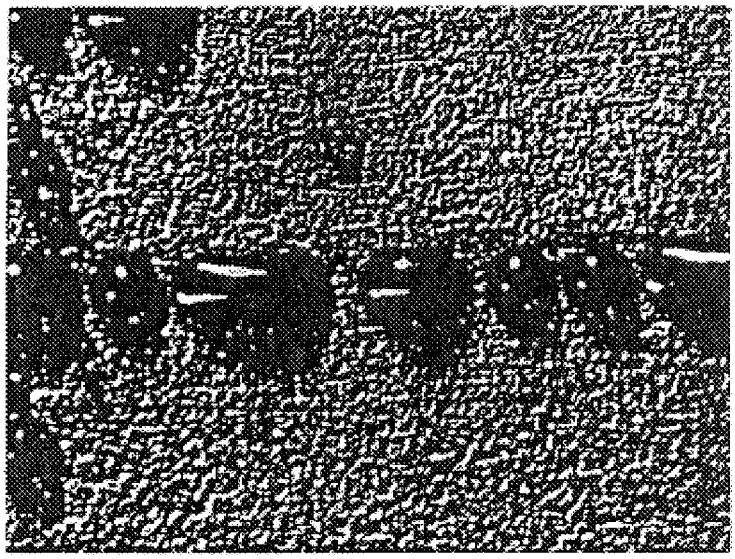
FIG. 3C PRIOR ART

The printing plates were also evaluated with respect to dot spreading. The dot size factor was determined by measuring the average size of the dots forming the cured image layer using an Olympus AH-D microscope with a NEOD-PLAN X10 lens. The image magnification was X190. The average dot size for each of the compositions of Examples 1, 2 and 3 were compared to the average dot size formed using a conventional hot melt ink "phase changc" composition prepared in accordance with U.S. Pat. No. 4,833,486. The conventional hot melt "phase change" ink composition is initially in a fluid state and has a measurable viscosity. Upon jetting the phase change inlk onto a substrate, the ink rapidly undergoes a phase change into a solid, i.e. essentially a material having an infinite viscosity. Such a phase change results in an infinite viscosity and prevents spreading of the ink droplet on the substrate. Accordingly, the average dot size of the conventional hot melt phase change ink composition is assigned a value of 1. The ratio of the average dot size of the compositions in accordance with the convention to that of the hot melt phase change ink composition is reported in Table 2. Photographs of the dots formed using the compositions of Example 3, Example 2, and the Standard Phase Change Ink are shown in FIGS. 3A–3C, respectively.

TABLE 2

| | Ex. 1 | Ex 2 | Ex. 3 | Ex. 4 | Ex. 5 | Ex. 6 |
|---|---|---|---|---|---|---|
| Initial Appearance (20° C.) | — | — | Gel | Gel | Gel | Gel |
| Viscosity at Yield Stress ($T_s$ = 25° C.) (Pa.s.) | 6 | 40 | 5,000 | 3,000 | 1500 | 30,000 |
| Viscosity @ 120° C. (Pa.s.) | 0.018 | 0.015 | 0.025 | 0.025 | 0.025 | 0.025 |
| $\eta_1/\eta_2$ | 333 | 2,667 | 200,000 | 120,000 | 60,000 | 1,200,000 |
| MEK-Rub t + 24 hours | 50 | 20 | 50 | N/A | 50 | 110 |

TABLE 2-continued

| | Ex. 1 | Ex 2 | Ex. 3 | Ex. 4 | Ex. 5 | Ex. 6 |
|---|---|---|---|---|---|---|
| Dot Size Factor | 10 | 2 | 1 | 1 | — | — |
| Press Run Length | — | >100,000 | — | — | — | — |

As illustrated in Table 2 above, Examples 2, 3 and 4 of this invention yielded superior results in terms of reducing dot spreading. Example 2 also exhibited excellent press run length. The composition of Example 1 exhibited a viscosity ratio of 333 which provided a spreading dot size factor marginally suitable for commercial purposes where the jetted ink drop is sufficiently small.

It will be understood that this invention is not limited to the above-described embodiments. Those skilled in the art having the benefit of the teachings of the present invention as hereinabove set forth, can effect numerous modifications thereto. These modifications are to be construed as being encompassed with the scope of the present invention as set forth in the appended claims. For example, and without limitation, while the exemplary embodiments contained herein have been described regarding the preparation of lithographic printing plates, the present invention can be used in the preparation of printing plates for flexographic printing, gravure printing or any other printing form where an image area (or negative image area) can be ink jetted onto a suitable substrate.

We claim:

1. A printing plate prepared by the process comprising:

(a) providing a substrate;

(b) applying a fluid composition to the substrate by ink jetting the fluid composition onto the substrate at a jetting temperature $T_2$, the substrate having a substrate temperature $T_s$, the fluid composition having a first viscosity $\eta_1$ at the substrate temperature $T_s$ and a second $\eta_2$ viscosity at the temperature $T_2$, wherein $\eta_1/\eta_2$ is about or greater than 300, wherein the fluid composition remains fluid upon application to the substrate; and (c) curing the fluid composition on the substrate thereby forming a printing plate.

2. The printing, plate of claim 1, wherein $T_2$ is greater than $T_s$.

3. The printing plate of claim 1, wherein $T_2$ is about or greater than 120° C.

4. The printing plate of claim 1, wherein $T_2$ is about or greater than 150° C.

5. The printing plate of claim 1, wherein $T_2$ is about or greater than 180° C.

6. The printing plate of claim 1, wherein $\eta_1/\eta_2$ is about or greater than 2,500.

7. The printing plate of claim 1, wherein $\eta_1/\eta_2$ is about or greater than 50,000.

8. The printing plate of claim 1, wherein the fluid composition comprises at least one cationically polymerizable composition, and at least one photo-initiator.

9. The printing plate of claim 8, wherein the cationically polymerizable composition comprises an epoxy composition.

10. A printing plate prepared by the process comprising:

(a) providing a substrate;

(b) applying a fluid composition to the substrate by ink jetting the fluid composition onto the substrate at a jetting temperature $T_2$, the substrate having a substrate temperature $T_s$, the fluid composition having a first viscosity $\eta_1$ at the substrate temperature $T_s$ and a second $\eta_2$ viscosity at the temperature $T_2$, wherein $\eta_1/\eta_2$ is about or greater than 300; and (c) curing the fluid composition on the substrate thereby forming a printing plate, wherein the fluid composition comprises at least one cationically polymerizable composition, and at least one photo-initiator, wherein the cationically polymerizable composition comprises an epoxy composition comprising at least one noncycloaliphatic epoxy composition, at least one cycloaliphatic epoxy compound, and at least one ultraviolet radiation initiator compound.

11. The printing plate of claim 10, wherein the noncycloaliphatic epoxy composition is at least one selected from the group consisting of diglycidyl ether of bisphenol A, an alpha-olefin epoxide, a novolac glycidyl ether, epoxidized linseed oil, epoxidized soy oil, epoxidized polybutadiene, 1,2-epoxydecane, glycidyl ether, alkyl glycidylether, glycidoxy-methoxy silane, glycidoxy-ethoxy silane, and 2-ethylhexylglycidyl ether.

12. The printing plate of claim 10, wherein the cycloaliphatic epoxy compound is at least one selected from the group consisting of 3,4-epoxycyclohexylmethyl 3,4-epoxy-cyclohexane carboxylate, bis(3,4-epoxy-cyclohexylmethyl) adipate, limonene, monoepoxide, limonene diepoxide, 1-vinyl-3,4-epoxycyclohexane, epoxidized dicyclopentyl alcohol, and 1,3-bis(2-(7-oxabicyclo (4.1.0)hepta-3-yl)ethyl)-1,1,3,3-tetramethyldisiloxane.

13. The printing plate of claim 10, in which the cycloaliphatic epoxy compound is 3,4-epoxy cyclohexyl methyl -3,4-epoxy cyclohexyl carboxylate and the noncycloaliphatic epoxide is a novolac glycidyl ether.

14. The printing plate of claim 10, wherein the ultraviolet radiation initiator compound is a photoreactive onium salt.

15. The printing plate of claim 10, in which the ultraviolet radiation initiator compound is triaryl sulfonium hexafluoroantimonate.

16. A printing plate prepared by the process comprising:

(a) providing a substrate;

(b) applying a fluid composition to the substrate by ink jetting the fluid composition onto the substrate at a jetting temperature $T_2$, the substrate having a substrate temperature $T_s$, the fluid composition having a first viscosity $\eta_1$ at the substrate temperature $T_s$ and a second $\eta_2$ viscosity at the temperature $T_2$, wherein $\eta_1/\eta_2$ is about or greater than 300; and (c) curing the fluid composition on the substrate thereby forming a printing plate, wherein the fluid composition comprises di-trimethylol propane.

17. A method of preparing a printing plate, the method comprising:

(a) providing a substrate;

(b) applying a fluid composition to the substrate by ink jetting the fluid composition onto the substrate at a jetting temperature $T_2$, the substrate having a substrate temperature $T_s$, the fluid composition having a first viscosity $\eta_1$ at the substrate temperature $T_s$ and a second $\eta_2$ viscosity at the temperature $T_2$, wherein $\eta_1/\eta_2$ is about or greater than 300; wherein the fluid composition remains fluid upon application to the substrate; and (c) curing the fluid composition on the substrate thereby forming a printing plate.

18. The method of claim 17, wherein $T_2$ is greater than $T_s$.

19. The method of claim 17, wherein $T_2$ is about or greater than 120° C.

20. The method of claim 17, wherein $T_2$ is about or greater than 150° C.

21. The method of claim 17, wherein $T_2$ is about or greater than 180° C.

22. The method of claim 17, wherein $\eta_1/\eta_2$ is about or greater than 2,500.

23. The method of claim 17, wherein $\eta_1/\eta_2$ is about or greater than 50,000.

24. The method of claim 17, wherein the fluid composition comprises at least one cationically polymerizable composition and at least one photo-initiator compound.

25. The method of claim 24, wherein the cationically polymerizable composition comprises an epoxy composition.

26. A method of preparing a printing plate, the method comprising:

(a) providing a substrate;

(b) applying a fluid composition to the substrate by ink jetting the fluid composition onto the substrate at a jetting temperature $T_2$, the substrate having a substrate temperature $T_s$, the fluid composition having a first viscosity $\eta_1$ at the substrate temperature $T_s$, and a second $\eta_2$ viscosity at the temperature $T_2$, wherein $\eta_1/\eta_2$ is about or greater than 300; and (c) curing the fluid composition on the substrate thereby forming a printing plate, wherein the fluid composition comprises at least one cationically polymerizable composition and at least one photo-initiator compound, wherein the cationically polymerizable composition comprises an epoxy composition comprising at least one noncycloaliphatic epoxy composition, at least one cycloaliphatic epoxy compound, and at least one ultraviolet radiation initiator compound.

27. The method of claim 26, wherein the noncycloaliphatic epoxy composition is selected from the group consisting of diglycidyl ether of bisphenol A, an alpha-olefin epoxide, a novolac epoxide, epoxidized linseed oil, epoxidized soy oil, epoxidized polybutadiene, 1,2-epoxydecane, glycidyl ether, alkyl glycidylether, glycidoxy-methoxy silane, glycidoxy-ethoxy silane, and 2-ethylhexylglycidyl ether.

28. The method of claim 26, wherein the cycloaliphatic epoxy compound is at least one selected from the group consisting of 3,4-epoxycyclohexylmethyl 3,4-epoxycyclohexane carboxylate, bis (3,4-epoxy-cyclohexylmethyl)adipate, limonene monoepoxide, limonene diepoxide, 1-vinyl-3,4-epoxycyclohexane, epoxidized dicyclopentyl alcohol, and 1,3-bis(2-(7-oxabicyclo(4.1.0)hepta-3-yl)ethyl)-1,1,3,3-tetramethyldisiloxane.

29. The method of claim 26, in which the cycloaliphatic epoxy compound is 3,4-epoxy cyclohexyl methyl -3,4-epoxy cyclohexyl carboxylate and the noncycloaliphatic epoxide is a novolac glycidyl ether.

30. The method of claim 26, wherein the ultraviolet radiation initiator compound is a photoreactive onium salt.

31. The method of claim 26, in which the ultraviolet radiation initiator compound is triaryl sulfonium hexafluoroantimonate.

32. A method of preparing a printing plate, the method comprising:

(a) providing a substrate;

(b) applying a fluid composition to the substrate by ink jetting the fluid composition onto the substrate at a jetting temperature $T_2$, the substrate having a substrate temperature $T_s$, the fluid composition having a first viscosity $\eta_1$ at the substrate temperature $T_s$, and a second $\eta_2$ viscosity at the temperature $T_2$, wherein $\eta_1/\eta_2$ is about or greater than 300; and (c) curing the fluid composition on the substrate thereby forming a printing plate, wherein the fluid composition comprises di-trimethylol propane.

33. A method of controlling the spreading of a fluid composition comprising:

(a) providing a substrate;

(b) applying a fluid composition to the substrate by ink jetting the fluid composition onto the substrate at a jetting temperature $T_2$, the substrate having a substrate temperature $T_s$, the fluid composition having a first viscosity $\eta_1$ at the substrate temperature $T_s$ and a second $\eta_2$ viscosity at the temperature $T_2$, wherein $\eta_1/\eta_2$ is about or greater than 300, wherein the fluid composition remains fluid upon application to the substrate; and (c) curing the fluid composition on the substrate.

34. The method of claim 33, wherein $\eta_1/\eta_2$ is about or greater than 2,500.

35. The method of claim 33, wherein $\eta_1/\eta_2$ is about or greater than 50,000.

36. A method of controlling the spreading of a fluid composition comprising:

(a) providing a substrate;

(b) applying a fluid composition to the substrate by ink jetting the fluid composition onto the substrate at a jetting temperature $T_2$, the substrate having a substrate temperature $T_s$, the fluid composition having a first viscosity $\eta_1$ at the substrate temperature $T_s$ and a second $\eta_2$ viscosity at the temperature $T_2$, wherein $\eta_1/\eta_2$ is about or greater than 300; and (c) curing the fluid composition on the substrate, wherein the fluid composition comprises at least one noncycloaliphatic epoxy composition, at least one cycloaliphatic epoxy compound, and at least one ultraviolet radiation initiator compound.

37. A method of controlling the spreading of a fluid composition comprising:

(a) providing a substrate;

(b) applying a fluid composition to the substrate by ink jetting the fluid composition onto the substrate at a jetting temperature $T_2$, the substrate having a substrate temperature $T_s$, the fluid composition having a first viscosity $\eta_1$ at the substrate temperature $T_s$ and a second $\eta_2$ viscosity at the temperature $T_2$, wherein $\eta_1/\eta_2$ is about or greater than 300; and (c) curing the fluid composition on the substrate, wherein the fluid composition comprises di-trimethylol propane.

38. A method of forming an image on a substrate comprising the steps of:

(a) providing a substrate;

(b) applying a fluid composition to the substrate by ink jetting the fluid composition onto the substrate at a jetting temperature $T_2$, the substrate having a substrate temperature $T_s$, the fluid composition having a first viscosity $\eta_1$ at the substrate temperature $T_s$ and a second $\eta_2$ viscosity at the temperature $T_2$, wherein $\eta_1/\eta_2$ is about or greater than 300; wherein the fluid composition remains fluid upon application to the substrate; and forms the image; and (c) curing the fluid composition on the substrate.

39. The method of claim 38, wherein $\eta_1/\eta_2$ is about or greater than 2,500.

40. The method of claim 38, wherein $\eta_1/\eta_2$ is about or greater than 50,000.

41. A method of forming an image on a substrate comprising the steps of:

(a) providing a substrate;

(b) applying a fluid composition to the substrate by ink jetting the fluid composition onto the substrate at a jetting temperature $T_2$, the substrate having a substrate temperature $T_s$, the fluid composition having a first viscosity $\eta_1$ at the substrate temperature $T_s$ and a second $\eta_2$ viscosity at the temperature $T_2$, wherein $\eta_1/\eta_2$ is about or greater than 300; and wherein the fluid composition forms said image; and (c) curing the fluid composition on the substrate, wherein the fluid composition comprises at least one noncycloaliphatic epoxy composition, at least one cycloaliphatic epoxy compound, and at least one ultraviolet radiation initiator compound.

42. A method of forming an image on a substrate comprising the steps of:

(a) providing a substrate;

(b) applying a fluid composition to the substrate by ink jetting the fluid composition onto the substrate at a jetting temperature $T_2$, the substrate having a substrate temperature $T_s$, the fluid composition having a first viscosity $\eta_1$ at the substrate temperature $T_s$ and a second $\eta_2$ viscosity at the temperature $T_2$, wherein $\eta_1/\eta_2$ is about or greater than 300; and wherein the fluid composition forms said image; and (c) curing the fluid composition on the substrate, wherein the fluid composition comprises di-trimethylol propane.

43. A method of copying an image onto a medium comprising the steps of:

(a) providing a substrate;

(b) applying a fluid composition to the substrate by ink jetting the fluid composition onto the substrate at a jetting temperature $T_2$, the substrate having a substrate temperature $T_s$, the fluid composition having a first viscosity $\eta_1$ at the substrate temperature $T_s$ and a second $\eta_2$ viscosity at the temperature $T_2$, wherein $\eta_1/\eta_2$ is about or greater than 300; wherein the fluid composition remains fluid upon application to the substrate; and forms said desired image;

(c) curing the fluid composition on the substrate to form a printing plate;

(d) running the printing plate on a press to reproduce the image on the medium.

* * * * *

UNITED STATES PATENT AND TRADEMARK OFFICE

CERTIFICATE OF CORRECTION

PATENT NO. : 6,427,597 B1
DATED : August 6, 2002
INVENTOR(S) : Patrice M. Aurenty et al.

It is certified that error appears in the above-identified patent and that said Letters Patent is hereby corrected as shown below:

Title page,
Item [56], FOREIGN PATENT DOCUMENTS, "0881584" needs to be changed to -- 0882584 --

Column 11,
Line 45, after "printing" take out comma

Signed and Sealed this

Eighth Day of April, 2003

JAMES E. ROGAN
*Director of the United States Patent and Trademark Office*